United States Patent [19]

Crosby

[11] 4,272,658

[45] Jun. 9, 1981

[54] MULTI-CONTACT ROTARY SWITCH

[75] Inventor: John B. Crosby, Yorba Linda, Calif.

[73] Assignee: Beckman Instruments, Inc., Fullerton, Calif.

[21] Appl. No.: 961,165

[22] Filed: Nov. 16, 1978

[51] Int. Cl.[3] ..... H01H 19/60

[52] U.S. Cl. ..... 200/6 B; 200/6 BB; 200/11 R; 200/17 R; 200/153 L

[58] Field of Search ..... 200/6 B, 6 BB, 6 C, 200/7 R, 38 B, 38 C, 38 BA, 38 CA, 303, 292, 153 L, 283

[56] References Cited

U.S. PATENT DOCUMENTS

| | | | |
|---|---|---|---|
| 2,703,347 | 3/1955 | Constantine | 200/38 C X |
| 2,796,498 | 6/1957 | Daily et al. | 200/11 DA |
| 3,562,464 | 2/1971 | Vollum et al. | 200/292 X |
| 3,609,258 | 9/1971 | Leland | 200/11 DA |
| 3,819,886 | 6/1974 | Homan et al. | 200/38 B |
| 4,012,606 | 3/1977 | Hutt | 200/6 B X |
| 4,133,990 | 1/1979 | Wanner et al. | 200/6 B |
| 4,196,324 | 4/1980 | Kojima et al. | 200/11 A |

*Primary Examiner*—James R. Scott

*Attorney, Agent, or Firm*—R. J. Steinmeyer; F. L. Mehlhoff; Thomas J. Plante

[57] ABSTRACT

A multi-contact rotary switch in which arcuate cam lobes on the planar faces of a rotatable disc-shaped cam rotor selectively engage a plurality of switch elements. Each switch element is attached to one of two switch blocks positioned adjacent to either cam rotor face. Slots in the switch blocks laterally confine the switch elements to preserve their alignment. A raised annular bearing on the cam rotor face maintains the position of the cam rotor relative to the switch blocks. Terminal extensions from the switch elements extend perpendicular to and away from the planar faces of the cam rotor.

6 Claims, 7 Drawing Figures

MULTI-CONTACT ROTARY SWITCH

BACKGROUND OF THE INVENTION

This invention relates to multi-contact rotary switches, and particularly to switches of the type in which cam lobes on a rotatable member are arranged to selectively control a plurality of circuits by causing independently operable switch contact elements to move into and out of their circuit-closing positions.

Many multi-contact rotary switches have been designed, but none have been found to meet the requirements which led to the present invention. The purpose is to develop a compact rotary switch which will be well suited for use as a range/function switch in digital multimeters and like instruments. There are at least three important goals in developing such a switch:

a. It should minimize manufacturing costs by utilizing a minimum number of parts which lend themselves to efficient manufacturing methods;
b. It should be very compact relative to the number of switching circuits provided; and
c. It should be highly efficient and reliable in accomplishing its switching functions, which requires that it have high voltage breakdown capability, both from switch to switch and also between the terminals of cooperating switch elements.

The separate Prior Art Statement lists the patents found in a novelty search. Of those, two appear to be useful in defining the background of the present invention. Edwards U.S. Pat. No. 3,845,256 discloses a cam-operated timer switch having in combination (note FIG. 4): (a) a disc-shaped timing cam having on its side face a plurality of concentrically disposed, radially spaced arcuate cam tracks, and (b) a plurality of switches operated individually by separate cam tracks, each switch combining a stationary contact and a flexible blade engageable with the stationary contact under control of the aligned cam track. Gerhardt U.S. Pat. No. 2,586,797 shows a printed circuit timer which combines (see FIGS. 5, 6 and 9) modular housing units, modular current selector means, and modular timing circuit boards to simplify design and fabrication of the timer.

SUMMARY OF THE INVENTION

The present invention achieves the combined goals of economy, compactness and functional superiority by combining a number of concepts, which individually or collectively differ from prior devices, including the following:

a. A center cam rotor having cam tracks, or lobes, on both sides is mounted between two identical side members, or switch blocks, which each carry a plurality of switches separately actuated by the cam tracks;
b. The side members laterally (axially) confine the cam rotor by providing bearing surfaces which engage the cam rotor;
c. Each side member, or switch block, has two diametrically spaced banks of switches, the switches in each bank being actuated by half of the cam tracks to compensate for the greater acceptable density of cam track locations;
d. The movable element of each switch element pair is laterally confined in a groove, or channel, to insure proper alignment; and e. The movable element of each switch element pair is so designed as to provide substantial flexing after switch engagement, thereby insuring positive contacting force and contact wiping action.

The foregoing concepts dovetail effectively to produce a significantly improved rotary switch, which is ideally suited for its role in highly developed electronic instrumentation.

DETAILED DESCRIPTION OF PREFERRED EMBODIMENT

Figure 1:
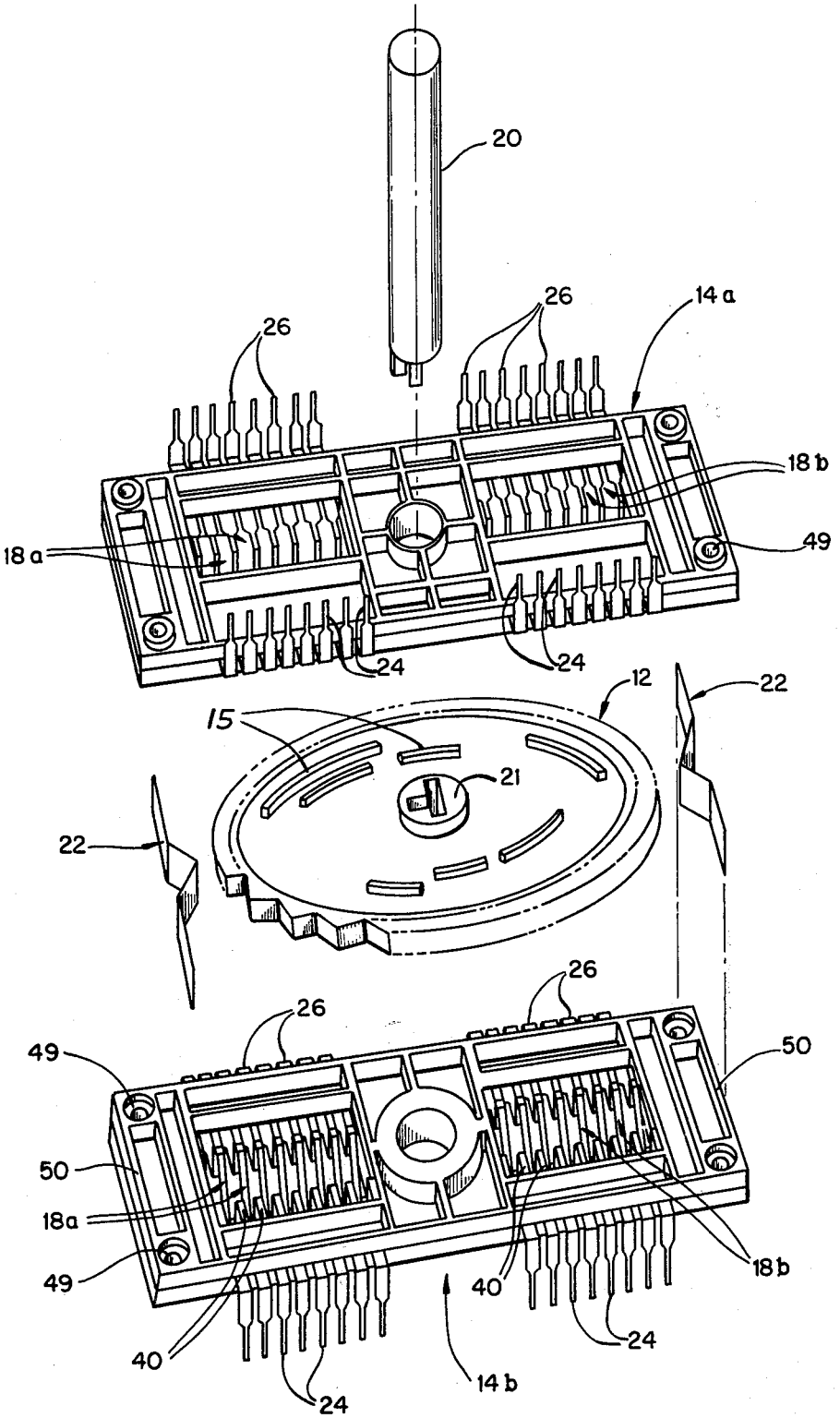
FIG. 1 is an exploded view in perspective of the rotary switch components.

As shown in FIG. 1, my improved rotary switch consists essentially of three structural elements: a central cam rotor 12, and two, preferably identical, side members, or switch blocks, **14*a* and 14*b*. When assembled the side members 14*a* and 14*b* confine the cam rotor 12 between them. Each side of the cam rotor 12 has a plurality of arcuate cam lobes 15, which are arranged, in the assembled structure, to cause selective operation of a plurality of switches 18**.

The only other parts shown in FIG. 1 are a shaft 20 which drivably engages the inside of hub 21 of the cam rotor 12, and two detent springs 22 which are held in place between the side members **14*a* and 14*b* at opposite ends thereof, for the purpose of indexing the positions of cam rotor 12**, i.e., yieldably retaining the cam rotor in any of numerous selected positions.

The two side members, or switch blocks, **14*a* and 14*b*** are of primary importance. They are intended to be identical, thus providing important manufacturing economies, while permitting a large amount of switching capability in a very small structure, because both sides of the cam rotor are fully utilized. Because the cam surfaces can carry a large amount of densely packed switch control information, while the individual switches require greater spacisng for adequate electrical isolation of the circuits, I have ,evised a two-bank arrangement.

As seen in FIG. 1, the group of switches designated **18*a* are located on the left portion, or "arm" of each of side members 14*a* and 14*b*, and the group of switches designated 18*b* are located on the right portion, or "arm" of each of side members 14*a* and 14*b*. The switches carried by side member 14*a* are not so clearly shown in FIG. 1, because the view shows the outer face of that side member, but they can be easily identified by the upwardly extending terminals. Each switch has two interengageable elements, one movable, and the other stationary. In order to connect to the electrical system in which the switch is used, each fixed and movable switch element preferably has an integral tail extension which is bent so as to extend away from the body of the assembled rotary switch device, thereby providing a terminal for connection to a circuit. The terminal extensions of the fixed switch elements are identified by the numeral 24, and the terminal extensions of the movable switch elements are identified by the numeral 26**.

Figure 3:
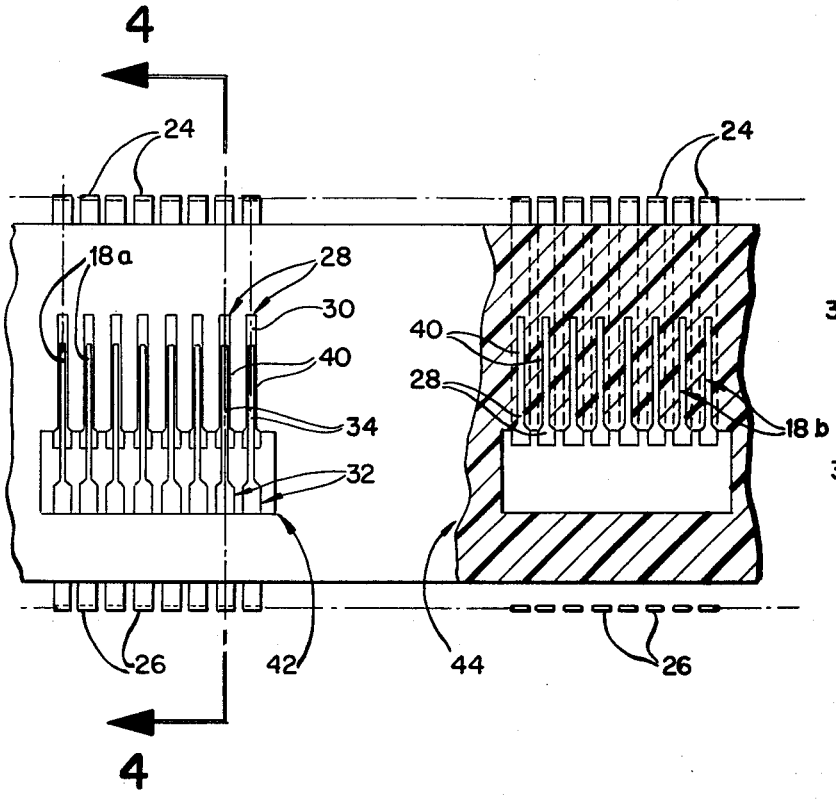
FIG. 3 is a cross-sectional view taken on the line 3—3 of FIG. 2.
Figure 4:
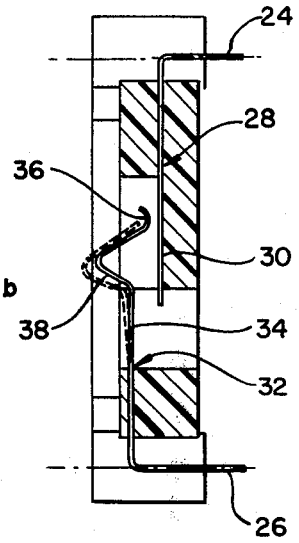
FIG. 4 is a cross-sectional view taken on the line 4—4 of FIG. 3.
Figure 2:
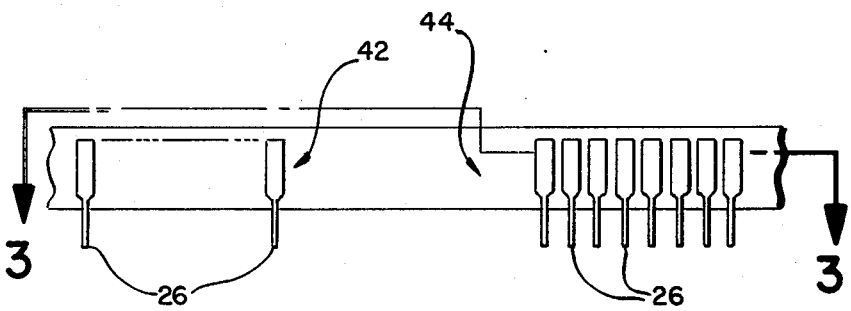
FIG. 2 is a side elevation showing the long dimension of one of the switch block members before it is incorporated in the complete rotary switch assembly as one of the identical side members thereof.

FIGS. 2, 3 and 4 show in greater detail the structure of each of the side members 14*a* and 14*b* before they are incorporated into the rotary switch assembly. FIG. 4 shows the shapes and relative positions of the fixed switch element and movable switch element which comprise each switch. The fixed switch element 28 has a flat blade portion embedded in the body of the side member and an integral terminal extension, or finger, 24. The flat blade portion has an uncovered portion 30 which is adapted to be engaged by the movable switch element.

The movable switch element 32 also has a portion embedded in the body of the side member and an integral terminal extension, or finger, 26. The unsupported portion 34 of the movable switch element constitutes a spring arm, or finger, which is normally biased away from engagement with the fixed switch element, but which is caused to move into engagment by the arcuate cam lobe which is designed to control that particular switch. (The dotted line position of spring arm 34 shown in FIG. 4 is the initial bias position prior to assembly of the cam rotor with the switch blocks). The cantilevered arm 34 of the movable spring element has a curved contact pad 36 near its end, and a somewhat V-shaped intermediate portion 38 which widens as it yields under switch engaging pressure provided by the cam lobe, thereby sliding the contact pad 36 longitudinally along the surface of the blade 30. This post-engagement deflection and sliding motion of the movable switch element has the dual purpose of insuring positive contacting force and causing contact wiping action. This contact wiping action cleans the contacts and assists in maintaining low switch noise. In the illustrated version of the invention, approximately 0.025 inch of positive overtravel (deflection) occurs after initial electrical contact has been made.

An important feature of the switch function is the confining of the contact end 36 of each movable switch element 32 in one of the guiding slots, or channels, 40 provided in the side members 14*a* and 14*b*. As shown in FIG. 3, these slots provide a comb-like structure which guides the arms of the moving switch elements 32 as they move into contact with, and slide along, the fixed switch elements 28. Because of the arcuate shape of the cam lobes 16, and the turning motion of the cam rotor 12 between its switch-selecting positions, there is a radial force exerted by the cam lobes 15 on the movable switch elements 32, which would tend to move them laterally out of switch contact except for the confining effect of channels 40.

Figure 5:
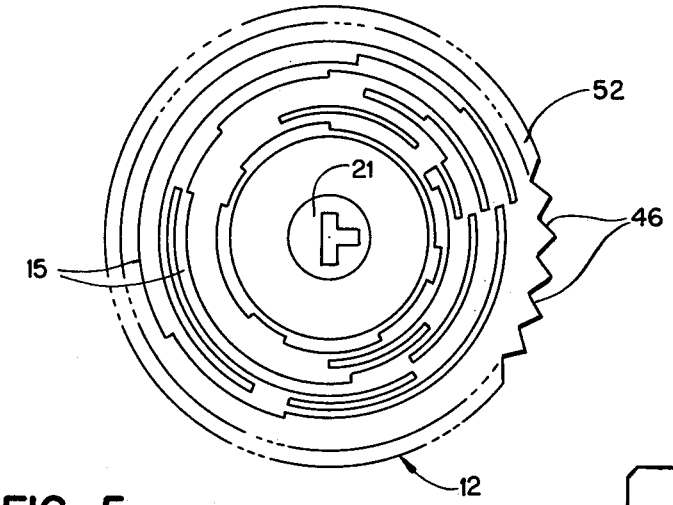
FIG. 5 is a plan view showing one camming surface of the disc-shaped camming member, or rotor, before it is incorporated in the complete rotary switch assembly.

In order to maintain adequate separation and isolation between switches, while at the same time taking advantage of the cam rotor's capability of permitting closer spacing of the cam lobes, the two-bank arrangement mentioned above has been devised. As seen in FIGS. 1, 3 and 4, there are a plurality of switches designated 18*a* mounted in the left-hand portion 42 of each switch block and an equal number of switches designated 18*b* mounted in the right-hand portion 44 of the same switch block. This arrangement permits the switches in one of the banks to be operated by the even-numbered cam lobes, whereas the switches in the other bank are operated by the odd-numbered cam lobes. Thus full utilization is obtained of the cam rotor information capability, without losing the desired spacing between adjacent switches. In the illustrated version of this invention, there are 8 switches in each bank, a total of 16 switches carried by each of the switch blocks 14*a* and 14*b*. Therefore, the complete rotary switch assembly has the capability of controlling 32 switches, since each side of cam rotor 12 has 16 cam lobes, or tracks, adapted to actuate the 16 switches carried by each of the switch blocks 14*a* and 14*b*. FIG. 5 shows a side view of the cam rotor 12 having its 16 closely formed cam lobes, or cam tracks, 15. Obviously, the particular number of cam lobes and switches used is not germane to the inventive concepts.

Figure 7:
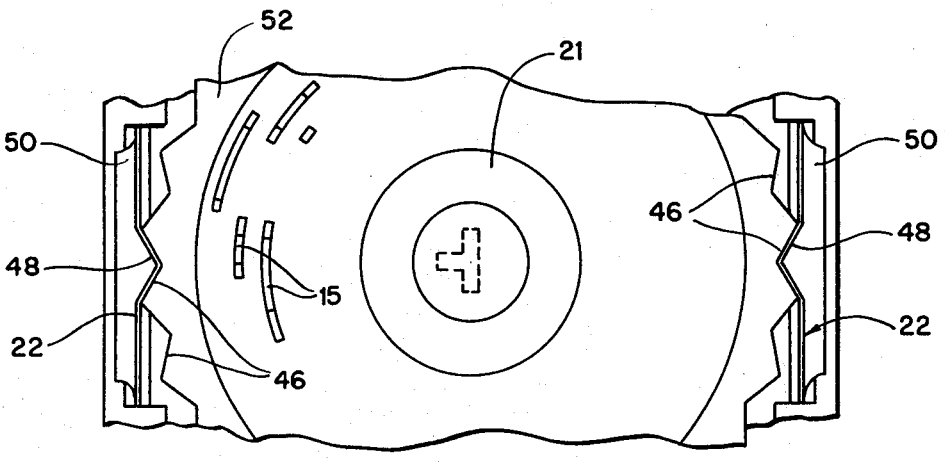
FIG. 7 is a plan view of the cam rotor and detent springs as they appear in the assembled rotary switch, the view being taken on the long dimension of the switch block side members.

As shown in FIGS. 1, 5 and 7, the periphery of cam rotor 12 is provided with dentent notches 46 which are selectively engaged by the resilient projections 48 of the lead-shaped detent springs 22, thereby yieldingly retaining the cam rotor in its selected position, until it is indexed to another position. The detent springs 22 are simple spring metal stampings which fit into, and are retained by, cavities 50 formed in the body of each of the side members 14*a* and 14*b*, the springs 22 bridging across between the side members. Preferably, two detent springs are used, at diametrically opposite sides of the cam rotor, in order to provide a balanced retention force. In the illustrated version of the invention there are 28 detent notches around the periphery of the cam rotor, permitting the rotary switch device to be serially switched through 28 detented switch positions in either the clockwise or counterclockwise direction.

Cam rotor 12 is retained in its axial (lateral) position in the rotary switch assembly by direct engagement with the inner surfaces of both side members 14*a* and 14*b*. The side members are secured together at their corners by suitable fastening means extending through holes 49. Preferably, the rotor is laterally supported both near its center and near its periphery. In other words, it is preferred that both the hub 21 and the rim 52 of rotor 12 have side engagement with the inner bearing surfaces provided on the side members 14*a* and 14*b*. The absence of any extraneous parts to support rotor 12 emphasizes the simplicity of the overall structure. This arrangement establishes the limits of axial play for rotor 12, and, by establishing a suitable plane for rotation of rotor 12, assures that the alignment and timing of cam lobes 15 with movable switch elements 32 will be exceptionally accurate.

The switch blocks, or side members, 14*a* and 14*b* are preferably made by an injection molding process. The first step is to prefabricate by stamping continuous metal strips containing large numbers of switch elements, one such strip containing fixed switch elements and another such strip containing movable switch elements. These large strips are subsequently cut into short lengths, each containing 16 switch elements. One short strip of each type (fixed and movable elements) is then placed in the mold which is used for injection molding the switch block. When the switch block body molding has been completed, spaced portions of the switch element strips are embedded therein. Subsequent operations separate the switch elements from their respective strips. Significant advantages accruing from this manufacturing technique are that the switch elements are assured of being well anchored, properly insulated, and correctly pre-aligned in the switch block. In addition, the method for producing the block is decidedly more economical and better suited to volume manufacturing than other known processes.

While various alternate materials may be successfully substituted, the following materials were found to be suitable for manufacturing rotary switch assemblies according to this invention. For molding switch blocks 14*a* and 14*b*, a polyester thermoplastic, such as Valox, was found to be ideal because of its low moisture absorption characteristics and ease of molding. Rotor 12 has been molded using an acetal polymer, such as Delrin, because the lubristic nature of this material makes it well suited to rubbing service. Although shaft 20 could have been molded as an integral part of rotor 12, it has been decided to mold it separately, using glass filled Valox to impart the high order of stiffness that is customarily desired in a control shaft. As previously stated, conventional stamping and forming processes have been used to fabricate switch elements 28 and 32. These parts may be fabricated from beryllium copper and then plated, first with nickel, and then with gold.

Figure 6:
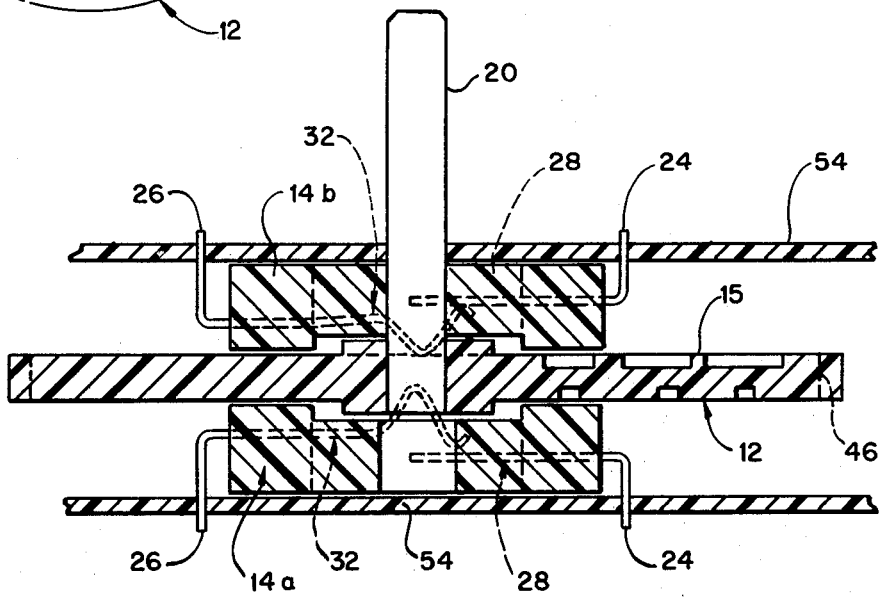
FIG. 6 is a cross-sectional view taken through the assembled rotary switch, showing the short dimension of the switch block side members.

FIG. 6 shows a fully assembled rotary switch structure mounted between two circuit boards 54. The upper switch is shown in closed position and the lower switch in open position.

As set forth during the foregoing description, this invention discloses a multi-contact rotary switch which incorporates several novel features to provide a structure which has the advantages of economic manufacture, compactness and functional reliabilty.

While in accordance with the patent statutes there has been shown and described what at present are believed to be the preferred embodiments of the invention, it will be obvious to those skilled in the art that various changes and modifications may be made therein without departing from the invention and it is, therefore, the aim of the appended claims to cover all such changes and modifications as fall within the true spirit and scope of the invention.

What is claimed is:

1. A multi-contact rotary switch structure comprising essentially the following three components:

two side members, each having a body structure composed of insulating material in which are embedded a plurality of parallel-extending switch element pairs, each pair comprising one fixed and one movable conductor element which have aligned interengageable portions; and a rotatable switch-controlling member mounted between the two side members and having a plurality of arcuate cam lobes on each of its sides, which lobes determine, in accordance with the position of the rotatable member, the contact or non-contact of each movable switch element with its paired fixed switch element;

the side members of the switch structure having guiding channels formed therein, each of which laterally confines one of the movable switch elements so as to insure its alignment with the corresponding fixed switch element.

2. A rotary switch comprising a switch block composed of insulating material having a surface in which a plurality of slots are formed;

a plurality of switch element pairs attached to the switch block, each of the slots in the switch block having a switch element pair positioned therein, each switch element pair comprising one fixed and one movable conductor element which have aligned interengageable portions, each movable element having a cam-follower portion protruding out of its slot and above said switch block surface, and each slot laterally confining the movable element therein so as to insure its alignment with its paired fixed element; and a rotatable switch-controlling member having a plurality of cam lobes which, in accordance with the position of the rotatable member, selectively displace the cam-follower portions of the movable switch conductor elements to determine the contact or non-contact of each movable conductor element with its paired fixed conductor element.

3. A rotary switch according to claim 2, further comprising a second switch block, structurally identical to the first switch block, to which are attached a plurality of switch element pairs structurally identical to the switch element pairs of the first switch block, the second switch block being positioned so that the rotatable switch-controlling member is between the two switch blocks.

4. A rotary switch according to claim 2 or 3 wherein each conductor element has a terminal extension which extends in a substantially perpendicular direction away from the plane of rotation of the cam rotor.

5. A multi-contact rotary switch structure, for use between two parallel printed circuit boards each having thereon a plurality of terminals, which switch structure comprises:

two switch blocks, each being composed of insulating material and each having a substantially planar surface, the switch blocks being disposed so that their respective planar surfaces are parallel to each other;

a plurality of switch element pairs attached to each switch block, each switch element pair comprising one fixed and one movable conductor element which have aligned interengageable portions, and each movable element having a cam-follower portion protruding above and away from the planar surface of the switch block to which it is attached; and a rotatable disc-shaped cam rotor having two substantially planar faces respectively positioned parallel to and adjacent to the planar surfaces of the two switch blocks, the axis of rotation of the cam rotor being perpendicular to the planar faces, and each planar face having thereon a plurality of cam lobes which, in accordance with the position of the rotatable member, selectively displace the cam-follower portions of the movable switch conductor elements to determine the contact or non-contact of each movable conductor element with its paired conductor element;

each conductor element further having a terminal extension which extends perpendicularly away from the plane of the cam rotor in order to provide an electrical connection with one of the terminals on the adjacent printed circuit board.

6. A multi-contact rotary switch structure, for use between two parallel printed circuit boards each having thereon a plurality of terminals, which switch structure comprises;

two side members, each having a body structure composed of insulating material in which are embedded a plurality of parallel-extending switch element pairs, each pair comprising one fixed and one movable conductor element which have aligned interengageable portions;

a rotatable switch-controlling member mounted between the two side members and having a plurality of arcuate cam lobes on each of its sides, which lobes determine, in accordance with the position of the rotatable member, the contact or non-contact of each movable switch element with its paired fixed switch element;

each switch element being a one-piece metallic element having an integral terminal extension which projects outwardly from the body structure in which it is embedded in a direction away from the rotatable member, in order to provide a direct electrical connection with one of the terminals on the adjacent printed circuit board.

* * * * *